US006755425B2

(12) United States Patent
Gorisch

(10) Patent No.: US 6,755,425 B2
(45) Date of Patent: Jun. 29, 2004

(54) TILT-STEERED ROLLING DEVICE

(76) Inventor: Wolfram Gorisch, Dueppeler Str. 20, Munich (DE), D-81929

( * ) Notice: Subject to any disclaimer, the term of this patent is extended or adjusted under 35 U.S.C. 154(b) by 131 days.

(21) Appl. No.: 10/026,567

(22) Filed: Dec. 26, 2001

(65) Prior Publication Data

US 2003/0116930 A1 Jun. 26, 2003

(51) Int. Cl.[7] ..... A63C 17/00

(52) U.S. Cl. ..... 280/11.27; 280/11.28; 280/11.223

(58) Field of Search ..... 280/11.27, 11.233, 280/11.26, 11.28, 11.34, 14.24, 17, 221, 239, 245, 246, 247, 254, 400, 62, 11.209, 11.19, 267, 87.042, 87.041

(56) References Cited

U.S. PATENT DOCUMENTS 117,329 A * 7/1871 Raitz ..... 280/11.27
151,768 A * 6/1874 Fenton ..... 280/11.27
1,228,111 A * 5/1917 Hardy ..... 280/11.27
3,746,118 A * 7/1973 Altorfer ..... 280/267
4,133,546 A * 1/1979 Rosenblum ..... 280/87.042
4,659,095 A * 4/1987 Halvorsen ..... 280/11.27
4,740,004 A * 4/1988 McMullen ..... 280/62
4,817,974 A * 4/1989 Bergeron ..... 280/11.209
5,116,069 A * 5/1992 Miller ..... 280/62
5,611,555 A * 3/1997 Vidal ..... 280/62
6,398,229 B1 * 6/2002 Saylor ..... 280/11.19

* cited by examiner

*Primary Examiner*—Bryan Fischmann
*Assistant Examiner*—Hau Phan

(57) ABSTRACT

A rolling device comprises a wheel pair, consisting of two wheels (3*a*, 3*b*)affixed to wheel-holders (4*a*, 4*b*), which are interconnected by two cross-guides (5, 6) thus forming a parallelogram link chain. One cross-guide (5) is rotatably secured to extension of the platform providing an acute angle between a rotation axis (9*a*) and the pivot axes (7*a*, 7*b*, 7*c*, 7*d*) of the four links which constitute the parallelogram link chain. The second cross-guide (6) is secured at the platform extension using a universal joint. One such tilt-steering wheel pair mechanism together with at least one fixed wheel is attached at opposite ends of the rolling device to make it work.

14 Claims, 4 Drawing Sheets

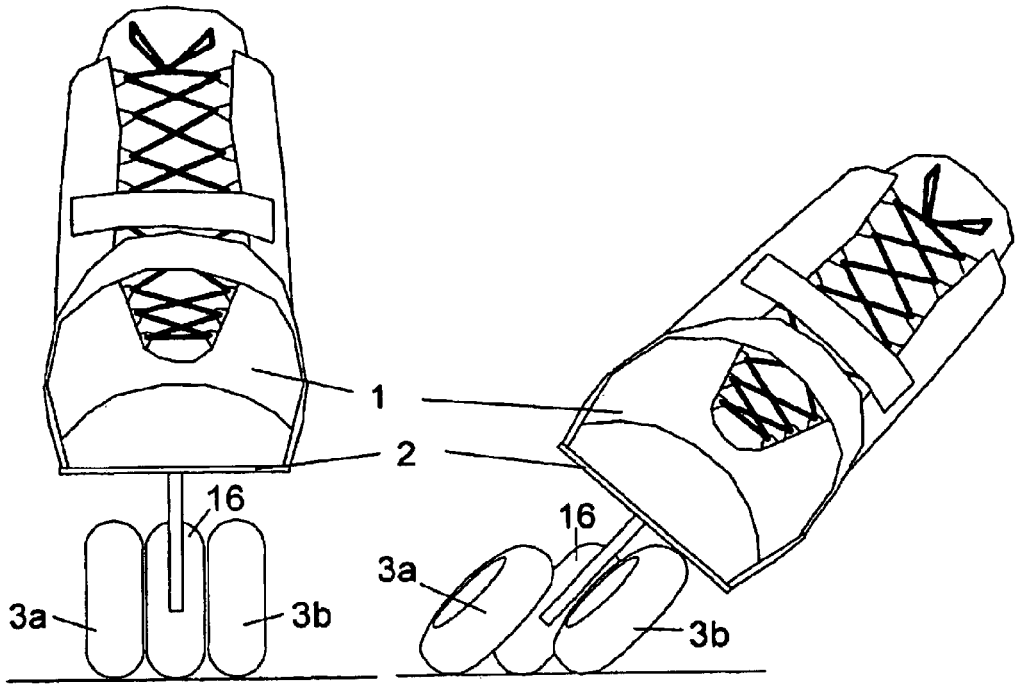
FIG. 1 a) b)
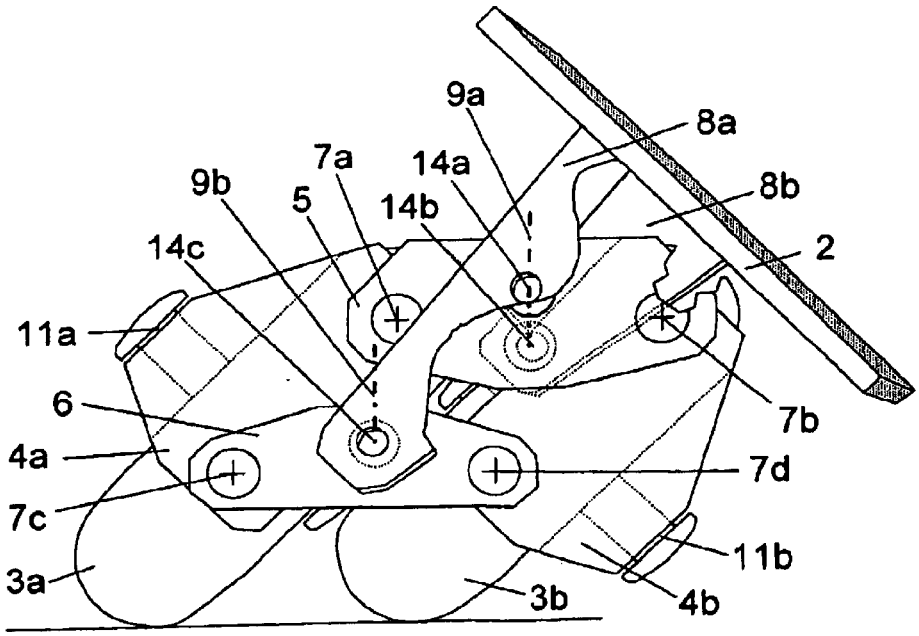
FIG. 2

TILT-STEERED ROLLING DEVICE

BACKGROUND OF THE INVENTION

This invention relates to rolling devices such as roller skates, inline skates, skateboards, scooters, skis on wheels, wheel chairs, tricycles etc. Roller skates and skateboards are known which provide two non-tiltable wheel pair mechanisms, named trucks, one at each end, wherein the platform can be tilted sideways and the wheels steer responding to the tilt by making the trucks rotate, comprising inclined rotation axes, thereby influencing the direction in which the wheels are rolling. Usually cylindrical wheels are used that cause undesirably high friction. Upon tilting, the mass acceleration forces are directed off the midline of the wheels' tracks, loading the wheels unequally and finally limiting the maximum tilt angle. In line skates, however, tilt as a whole. They are equipped with the known narrow wheels, which have little friction, but they cannot be steered by tilt.

DE19803412A1 discloses tiltable and tilt-steered wheel supports, wherein the wheels are fixed to longitudinal guides, the latter functioning as a compound guide system based on two sets of longitudinal fourfold linked chains. Any such solution using longitudinal guides is technically complex. Another problem is that such a solution causes unequal loading on the wheels of each pair.

This disadvantage has been overcome by using cross-guides. WO85/03644A1 describes wheels affixed to holders, which are guided using cross-guides in order to form a parallelogram chain having four links each. The entire system is pivotally secured to a base plate, where the pivot axis is vertically oriented with respect to this base plate, like a bogie. Steering is coupled to the tilt by using two gear wheels where one gear wheel is attached to the base plate. This solution still requires many parts and is complex.

BRIEF SUMMARY OF THE INVENTION

A principal objective of the present invention is to provide a novel steering mechanism to be used in wholly tiltable rolling devices wherein the steering angle is coupled to the tilt angle in a simple and kinematically well defined manner. Another major objective of this invention is to provide a steering mechanism which distributes the radial load equally on the wheels. A further important objective of this invention is to provide a steering mechanism which uses only a few simple parts or standard components.

These advantages are attained as follows. A multi-tracked tilt-steered rolling device which incorporates pairs of tiltable wheels wherein the wheels are guided in form of a parallelogram is modified so that it comprises two cross-guides 5, 6 which are rotatably affixed to extensions 8*a*, 8*b* of the platform, their rotation axes 9*a*, 9*b* being at an angle a to the pivot axes 7*a*, 7*b*, 7*c*, 7*d*, of the parallelogram link chain. These two cross-guides 5, 6 attach pivotably to two separate wheel holders 4*a*, 4*b* where the pivot axes 7*a*, 7*b* of the first cross-guide 5 and the pivot axes 7*c*, 7*d* of the second cross-guide 6 are preferably oriented longitudinally and parallel, so that the known parallelogram link chain is formed. One wheel 3*a* is rotatably affixed to one wheel holder 4*a* and the other wheel 3*b* is rotatably affixed to the other wheel holder 4*b*. Alternatively the second cross-guide 6 is universally joined to the extension of the platform 2 using a universal joint 12. The angle $\alpha$ makes the rolling device capable to be steered by tilt.

BRIEF DESCRIPTION OF THE SEVERAL VIEWS OF THE DRAWING

FIG. 1 is a front view of a skate in the upright (FIG. 1*a*) and in the tilt-steered (FIG. 1*b*) positions.

FIG. 2 is a front view of the invented tilt-steering parallelogram link chain in the tilted position.

DETAILED DESCRIPTION OF THE INVENTION

Figure 3:
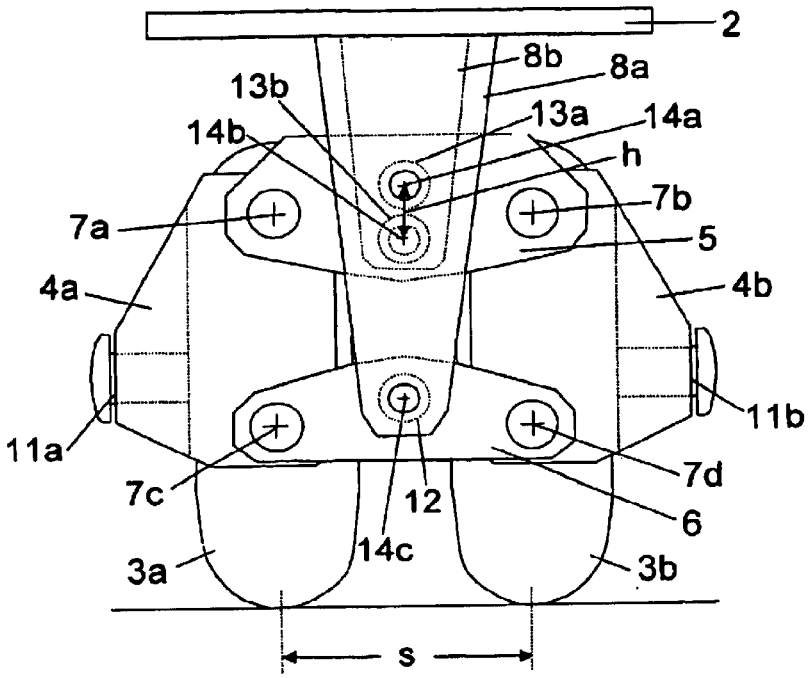
FIG. 3 is a front view of the preferred embodiment of the invented parallelogram link chain carrying the wheel pair, in the upright position.

As shown in FIG. 1 the directions which the wheel pair 3*a*, 3*b* and the guiding wheel 16 take, are equal and coincide with the longitudinal axis of the platform 2. FIG. 1*b* illustrates in the same general manner the tilted position of the skate, showing that the wheels are tilted as well, and showing also that the wheels 3*a*, 3*b* of the wheel pair have a steering angle with respect to both, the platform 2 and the guiding wheel 16. FIG. 3 shows the front view of a parallelogram link chain, which consists of the two wheel holders, left 4*a* and right 4*b*, and the two cross-guides, the first on top, 5, and the second below, 6. The parallelogram link chain, described by its four pivot axes 7*a*, 7*b*, 7*c*, 7*d* is rectangular, as shown in FIG. 3, or is a non-rectangular parallelogram, as shown in FIG. 2. The invention also includes the possibility that the four pivot axes resemble a trapezium (not drawn).

Figure 4:
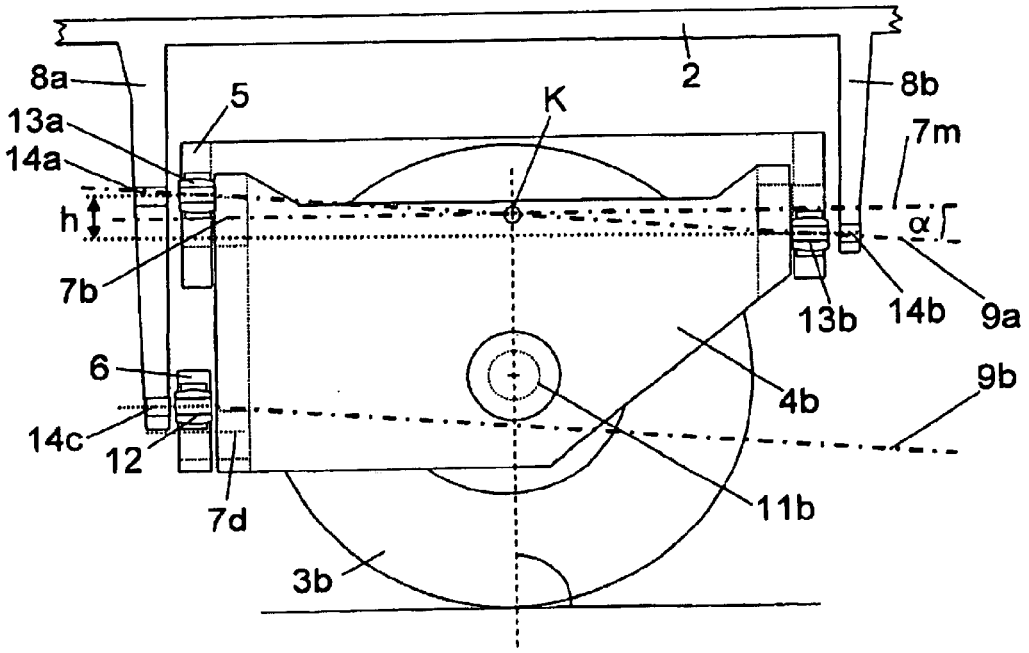
FIG. 4 is a side view of this embodiment.

FIGS. 2, 3 and 4 illustrate how the steering mechanism works. As the cross-guide 5 according to the invention is rotating, with the rotation axis 9*a* inclining at an angle $\alpha$ with respect to the pivot axes 7*a*, 7*b*, 7*c*, 7*d* of the link chain, the tilting of the platform 2 and its extensions 8*a*, 8*b* with respect to the cross-guide 5 will cause the end of the cross-guide 5 to swivel out of the center plane of the platform 2, as shown in FIG. 2. The other end of cross-guide 5 swivels inwards. This results in a steering angle which increases as the tilt angle increases. The kinematics is shown in FIG. 2, viewed in the direction of the axes 7*a*, 7*b*, 7*c*, 7*d*. The platform 2 is then seen at a shallow perspective angle.

Although FIGS. 2 to 5 anticipate that the axes 7*a*, 7*b*, 7*c*, 7*d* are oriented longitudinally with respect to the rolling device and are oriented parallel to the ground, this is not necessarily a prerequisite of the present invention. The essential condition for ensuring the tilt-steering function is the presence of an angle a as described above.

Figure 6:
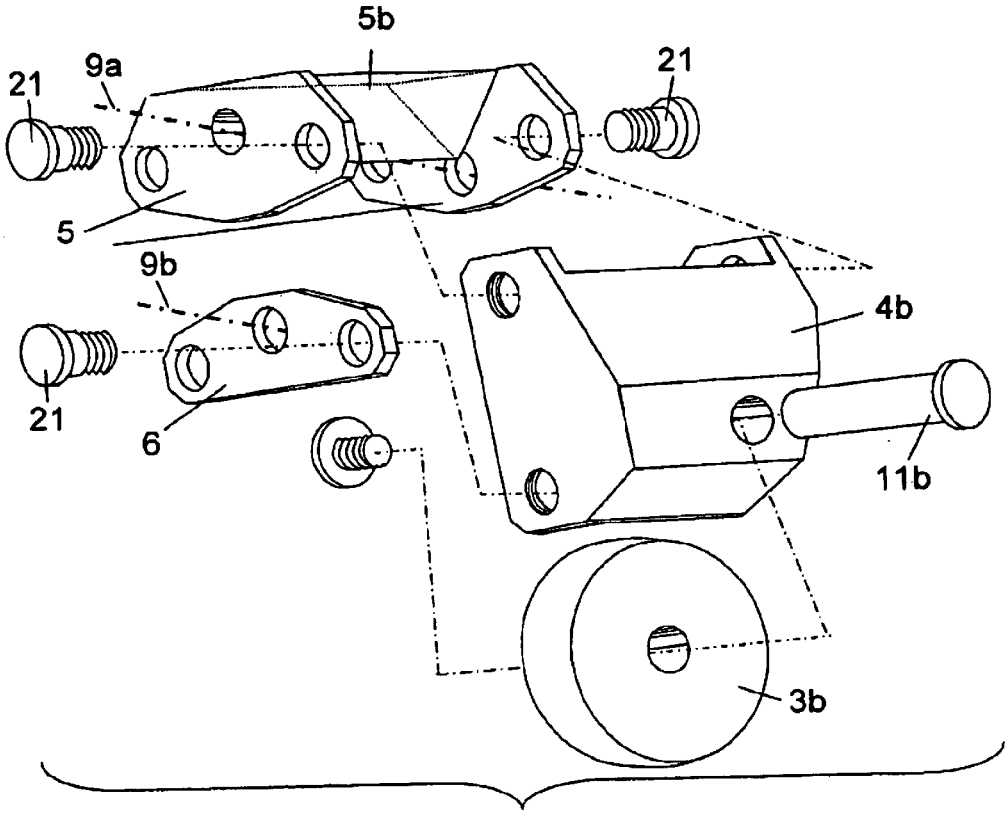
FIG. 6 is an exploded perspective view of part of the tilt-steering mechanism.
Figure 7:
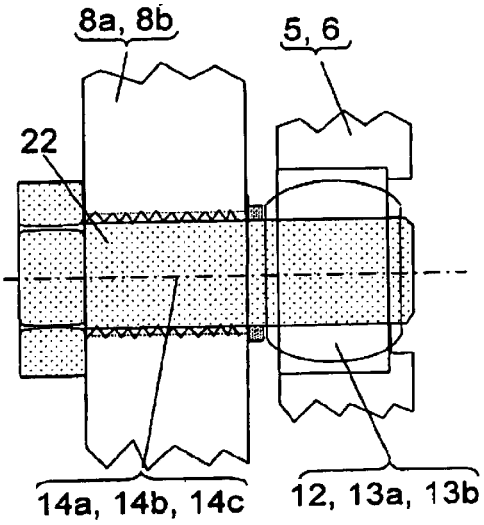
FIG. 7 is an enlarged view of a possible embodiment of the universal joint which connects the cross-guides with the extensions of the platform.

FIG. 6 shows the two cross-guides 5, 6, the right wheel holder 4*b*, one wheel 3*b* and its bolt and axle 11*b*. The respective symmetrical wheel and wheel holder from the left side are omitted. The cross-guide 5 incorporates a bridge 5*b* which has a cross-sectional area large enough to ensure high torsion stiffness. In this embodiment the cross-section of the bridge 5*b* is a triangle. The preferred embodiment of the invented obliquely swiveling parallelogram link chain contains six links, where the first cross-guide 5 has four holes and the second cross-guide 6 has two holes. Six bolts (three bolts 21 are shown in FIG. 7) or axles connect the two cross-guides 5, 6 with the two wheel holders 4*a*, 4*b* which accordingly have three eyeholes each to accommodate the six bolts or axles. These six links pivotally connecting the cross-guides with the wheel-holders can easily be designed in an obvious way. Steel bolts can also be combined with standard cylindrical bearings made from brass or plastic, which fit into the eye-holes (not drawn).

Figure 5:
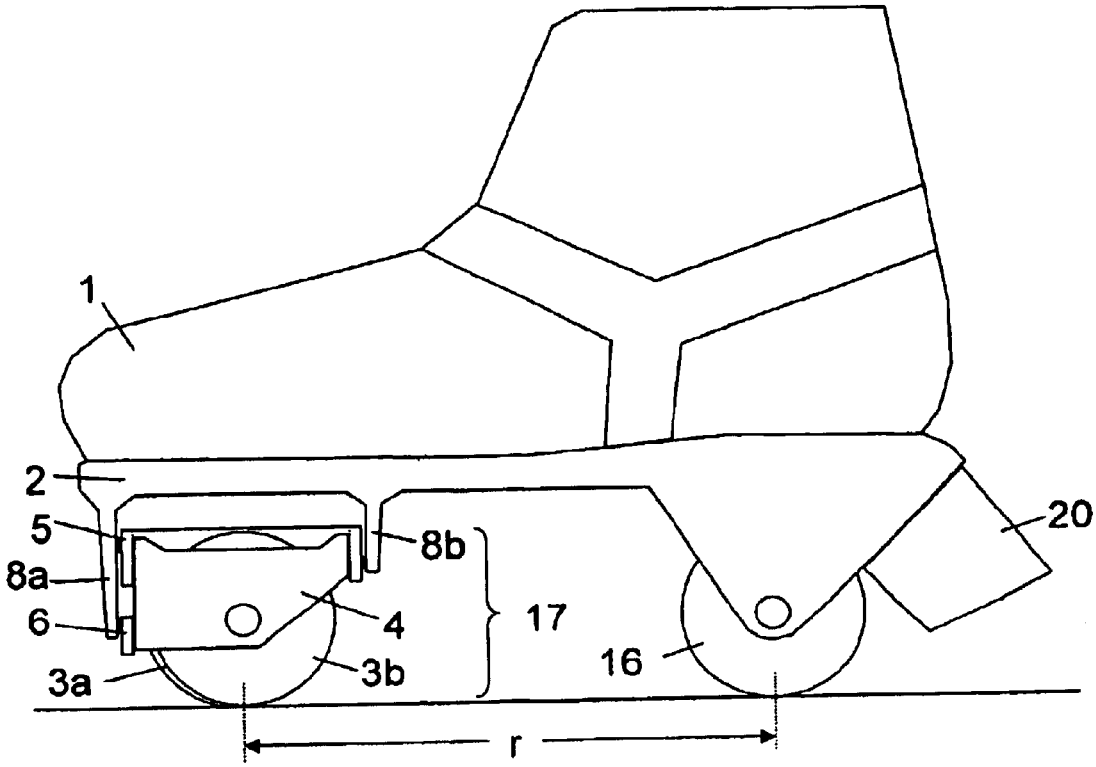
FIG. 5 is a side view of a skate which incorporates three wheels.

Referring to FIG. 5 the rolling device is able to steer along a curved track if the device has rotatably affixed to the platform at least one guiding wheel 16 which has a distance r (wheel base) to the wheels 3*a*, 3*b* of the wheel pair. Another parallelogram wheel pair mechanism can be used instead of using the one guiding wheel 16. Its angle α may be designed to be zero. In this case this wheel pair does not steer. The device's ability to curve is only determined by the steering function of those wheel pair mechanisms whose angles α are not zero.

The invented obliquely rotating parallelogram link chain mechanism only consists of a few simple parts. Design components can be cheaply molded, formed or machined. Materials used may include light metal such as aluminum or other strong or reinforced (e.g. glass or carbon fiber resin) plastic.

Certain applications e.g. roller skates, require the wheels to be placed underneath the platform 2. Upon tilting the platform, one wheel of the wheel pair 17 moves upwards approaching the platform 2, and the other wheel moves away from it. The space between the wheels and the platform needed for this movement increases with both the maximum tilt angle and the track width s between the two wheels 3*a*, 3*b* of the wheel pair. In order to minimize the space required i.e. in order to avoid an excessive "high-heeled" design, it is desirable to design the track width s to be as small as possible. As can be seen in FIG. 2, the lateral space between the two parallelogrammically guided wheels decreases upon tilting. In addition, space is required for affixing the wheels' axles 11*a*, 11*b*. This additional space can be spared, if necessary, if the axles are fixed to the wheel holder only at the outer side of the wheels.

If, upon tilting, the track width alters, at least one of the two wheels 3*a*, 3*b* will slide sideways on the ground, causing friction and wear. An embodiment is therefore preferred which stabilizes the track, avoiding friction or wear, by having the distance between the pivot axes 7*a* and 7*b* of the first cross-guide 5, which is equal to the distance between the pivot axes 7*c* and 7*d* of the second cross-guide 6, made now equal to the track width s by design.

The present invention is compatible with a design, where each of the two cross-guides 5, 6 has a cylindrical bored hole, both parallel to each other but obliquely oriented with respect to the pivot axes 7*a*, 7*b*, 7*c*, 7*d*, where the holes serve to accommodate axles to be affixed to extensions 8*a*, 8*b* of the platform. This embodiment is possibly kinematically over-defined, as (in brief) the two cross-guides are forced to move in a parallel orientation by two independent mechanisms, first by the two axles, secondly by the parallelogram link chain, both mechanisms possibly interfering with each other, if design tolerances are unfavorable. In order to avoid such interference, only one cross-guide 5 is supplied with a rotation axis 9*a* as mentioned, affixing this rotation axis 9*a* at extensions 8*a*, 8*b* of the platform 2, but supplying the second cross-guide 6 with a universal joint 12, e.g. in form of a spherical bushing or the like, connecting the cross-guide 6 with the extension 8*a* of the platform 2 using the universal joint 12 (see FIG. 4).

This invention may also imply that the rotation axis 9*a* is directed obliquely with respect to most of the component parts' edges and faces. Technically any skew angled drilling, washers, axles etc. cause considerably high manufacturing costs. The use of universal joints 13*a*, 13*b* ensures the function of an oblique rotation axis combined with hole drilling to be simply perpendicular to the part surfaces. The obliquity of the rotation axis 9*a* is ensured by placing the two universal joints 13*a* and 13*b* with a vertical offset h. The rotation axis 9*a* is now defined by the straight line through the centers of the two universal joints 13*a*, 13*b*. Another advantage of using universal joints instead of full-length axles is that the full-length axle needs space which in some designs is difficult to provide.

FIG. 7 shows how the parts can be connected using a spherical bushing as universal joint. A threaded bolt 22, having a cylindrical portion, is placed through the spherical bushing 12, 13*a*, or 13*b*. The parts to be connected are the cross-guide 5 resp. 6 to extension 8*a* resp. 8*b* of the platform 2. The bolts 22 have axes 14*a*, 14*b*, 14*c*.

Many rolling devices like roller skates or scooters need to be functionally right-left symmetrical. This symmetry is realized by having the oblique rotation axis 9*a* lie in the longitudinal vertical symmetry plane of the device. As the center parallel line 7*m* between axes 7*a* and 7*b* as well as the rotation axis 9*a* are lying within the symmetry plane, there exists a point K where the axes 9*a* and 7*m* intersect.

One of the objects of this invention is to avoid swiveling of the wheel pair out of the center line upon tilting. The wheels 3*a*, 3*b* of the wheel pair will, upon tilt, stay within the center line, if by design the intersection point K is positioned vertically above the axles 11*a*, 11*b*, as shown in FIG. 4.

An embodiment is proposed which ensures that the device, e.g. a roller skate, assumes a neutral position i.e. the upright non-tilted position, see FIG. 1*a*, when lifted from the ground. This objective is met by introducing a flexing means, which returns or maintains the wheel pair in the neutral position using the force of this flexible material or of a spring.

FIG. 5 illustrates that the device additionally incorporates a wheel 16 which is affixed longitudinally at a certain distance to the wheel pair, the wheel base r, in order to be able to be steered. Alternatively another tilt-steering wheel pair which is designed according to this invention can be affixed. The curve radius depends on the angles a which pertain to the one or two tilt-steering mechanisms. It also depends on the wheel base r. The curve radius becomes small when by design the angles α are chosen to be large and the wheel base r is small. For this new tilt-steering skates, α may range from 3 to 10 degrees to be useful. The wheel base r may range from 20 to 35 centimeter, dependent on the preferred use of the skate. For example the designer of speed-skates may allow for smooth long curves. The mentioned ranges for α and r are not meant to exclude other values. It is just this variability which opens ways to commercialize a wide variety of rolling devices specifically intended for different uses.

The most economic embodiment of the invention combines one tilt-steered wheel pair with one fixed wheel.

If four wheel are preferred because of improved weight distribution or to keep better the track then two tilt-steering wheel pairs 17 can be affixed at either end of the rolling device. It is to be noted that the rearmost affixed wheel pair should have its rotation axis 9*a* be designed to be declining, and that the front wheel pair should have its rotation axis 9*a* be designed to be inclining, both viewed from behind. An alternative four-wheeled embodiment combines one tilt-steering wheel pair with one pair of wheels in-line, both pairs being affixed at opposite ends of the rolling device (not drawn).

I claim:

1. A tilt-steered rolling device, comprising a platform which includes at least one extension, and comprising at least three wheels, two of them being arranged side by side as a wheel pair, the wheels of the wheel pair each being rotatably affixed to a separate wheel holder using axles, the two wheel holders being interconnected by two cross-guides using at least four pivot links forming a trapezium or a parallelogram link chain, wherein the first cross-guide is rotatably secured to at least one extension of the platform and the second cross-guide is jointed to at least one extension of the platform, and wherein the direction of the rotation axis of the first cross-guide is at an acute angle $\alpha$ to the direction of four pivot axes of the at least four links of the link chain.

2. A device as defined in claim 1, wherein each axle of the two wheels of the wheel pair is attached only to one side of the respective wheel holder.

3. A device as defined in claim 1, wherein the pivot axes of the first cross-guide are separated by a distance which is equal to the distance between the pivot axes of the second cross-guide.

4. A device as defined in claim 1, wherein the distance between the two pivot axes of the first cross-guide and the distance between the two pivot axes of the second cross-guide are both equal to the track width of the two wheels of the wheel pair.

5. A device as defined in claim 1, wherein the second cross-guide is rotatably secured to at least one extension of the platform wherein the rotation axis of the second cross-guide is directed parallel to the rotation axis of the first cross-guide.

6. A device as defined in claim 1, wherein two universal joints are used to allow the first cross-guide to rotate around a rotation axis where the rotation axis is defined by the centers of the two universal joints.

7. A device as defined in claim 1, wherein an intersection point (K) which is generated when the middle parallel line between the two upper pivot axes of the parallelogram link chain intersects with the rotation axis of the first cross-guide, is located vertically above the axles of the wheels of the wheel pair.

8. A device as defined in claim 7, wherein the intersection point (K) is located vertically above the axes of the wheels of the wheel pair.

9. A device as defined in claim 8, wherein the swivel axis which is defined by the centers of the two universal joints of the first cross-guide lies in the plane which extends along the central longitudinal axis of the platform and which is also oriented perpendicular to the platform.

10. A device as defined in claim 1, wherein a flexing means is comprised which forces the wheel pair to return from the tilt or which maintains it in a preferred neutral position.

11. A device as defined in claim 1, wherein a single wheel is rotatably affixed at one end of the device.

12. A device as defined in claim 1, wherein the device has tilt-steering wheel pairs at both ends.

13. A device as defined in claim 1, wherein an extension supporting a tilt-steering wheel pair is fixed flexibly to the platform at one point, to permit small movements of the wheel pair essentially vertically to the platform, and to allow inclusion of a shock absorbing device.

14. A device as defined in claim 1, wherein the device has one tilt-steered wheel pair and one wheel pair in-lines at opposite ends.

* * * * *